United States Patent [19]

Hsiung

[11] Patent Number: 4,691,965

[45] Date of Patent: Sep. 8, 1987

[54] JOINT ARRANGEMENT FOR KNOCKDOWN FURNITURE

[76] Inventor: Shu-Jen Hsiung, No. 549, Hsin Shu Road, Hsin Chuang City, Taipei Hsien, Taiwan

[21] Appl. No.: 906,447

[22] Filed: Sep. 12, 1986

[51] Int. Cl.[4] ..... A47C 7/00

[52] U.S. Cl. ..... 297/440; 297/443; 403/176

[58] Field of Search ..... 403/231, 171, 205, 403, 403/402, 382, 260, 176; 108/156; 297/440, 443

[56] References Cited

U.S. PATENT DOCUMENTS

| | | | |
|---|---|---|---|
| 1,524,330 | 1/1925 | Zinkgraf et al. | 297/440 |
| 1,644,336 | 10/1927 | Gunlocke et al. | 297/440 |
| 3,329,383 | 7/1967 | Pilliod et al. | 403/231 X |
| 4,072,433 | 2/1978 | Vehl | 403/176 |
| 4,347,015 | 8/1982 | Olashaw | 403/171 X |
| 4,577,906 | 3/1986 | Hsiung | 297/440 |

FOREIGN PATENT DOCUMENTS

| | | | |
|---|---|---|---|
| 2001301 | 2/1969 | France | 297/440 |

*Primary Examiner*—James T. McCall

*Attorney, Agent, or Firm*—Banner, Birch, McKie & Beckett

[57] ABSTRACT

A joint arrangement for knockdown furniture includes a first spar having two mounting surfaces at lateral sides thereof at a same level; a pair of second spars, each having two end faces, each attached perpendicularly at one end face thereof to one of the mounting surfaces, therefore having two inward faces forming an angle therebetween; a substantially trapezoidal joint piece having two side surfaces conforming to the angle for being screw attached to one of the first spar and the pair of second spars; and a guiding means comprising a ridge on one of the side surfaces and the inward faces and a corresponding groove on the other of the side surfaces and the inward faces, whereby the joint piece can be positioned easily and accurately during assembly to strengthen the joint. An improved knockdown chair is provided using this joint arrangement.

3 Claims, 7 Drawing Figures

JOINT ARRANGEMENT FOR KNOCKDOWN FURNITURE

BACKGROUND OF THE INVENTION

This invention relates to a novel joint arrangement for knockdown furniture and to a chair using the novel joint arrangement, which enables the chair to be easily assembled and disassembled but at the same time to be sturdy and attractive, without the flimsy appearance of much knockdown furniture, and which is not seen in the final assembly of the chair.

The advantages of knockdown furniture, such as decreased storage and transport costs, are well known. However, it is difficult for knockdown furniture to present the same sturdy and unbroken appearance as finished furniture which can not be disassembled. In particular, the smooth appearance of the joints of a piece of furniture portends its solidity and reflects the craftsmanship that has gone into it. It is thus desirable for knockdown furniture to have joints which are as easily constructed as possible, but which at the same time are firm and tight and do not mar the appearance of the furniture. For marketing purposes, it is also desirable that certain parts of knockdown furniture be interchangeable, so that the exact structure of the furniture can be varied to suit different customers' tastes.

The inventor of this invention has previously patented two inventions concerning joint arrangements for knockdown furniture. The first patent, U.S. Pat. No. 4,261,665, discloses a wooden members assembly of which a joint arrangement comprises an elongated pillar having a groove provided thereon for receiving the tongues of spar members, the groove having a through hole therein for receiving a screw bolt; a first elongated spar member, having a bushing provided therein; and a second elongated spar member, having a radial through hole at an end thereof. The joint is assembled by inserting a screw bolt from outside the hole of the pillar member through the radial through hole of the second spar member to engage with the bushing of the first spar member.

The patented invention '665 is suitable only for furniture which uses cylindrical braces or spars, and as such braces or spars have ends of relatively small cross section, in order to obtain a strong connection, solid joint circular recesses are formed in the opposing pillar member to seat the end of the spar. The resulting joint presents an angular appearance.

The second patent, U.S. Pat. No. 4,577,906, provides an armchair with a joint assembly suitable for joints between flat surfaces which are desired to present a smooth, streamlined appearance. The fastening means of the parts of the armchair includes, for each joint, a bolt and a bushing with a threaded longitudinal hole for receiving the bolt and a radial hole for receiving a locking pin. The bolt is provided through one and the bushing is provided in another of two abutting parts to be jointed together. Dowel pins fix the abutting parts in position for being jointed, and the joint is reinforced through wood screws obliquely inserted into the two joined parts. In this type of prior art joint assembly, the head of the bolt or the through hole receiving the same remains visible, as do the heads of the oblique wood screws or the through holes receiving them. Moreover, as the stress of the joint is focussed on the dowel pins, bolt, and wood screws, the joint is not as strong as might be desired.

SUMMARY OF THE INVENTION

This invention provides a novel joint arrangement for knockdown furniture which overcomes the deficiencies of the prior art, which can easily be mass-produced, which is suitable for quick assembly, and which presents a polished appearance suitable for a heavier piece of furniture.

This invention also provides a knockdown chair using a novel strengthened joint assembly including the joint arrangement of this invention, which can be used as a formal piece of furniture, as bolts and bushings of the joint are completely invisible from the outside of the armchair, and parts of which can be interchanged for variataion in the design of the chair.

The joint arrangement of this invention includes a first spar having two mounting surfaces at lateral sides thereof at a same level; a pair of second spars, each having two end faces, each attached perpendicularly at one end face thereof to one of the mounting surfaces, therefore having two inward faces forming an angle therebetween; a substantially trapezoidal joint piece having two side surfaces conforming to the angle for being screw attached to one of the first spar and the pair of second spars; and a guiding means comprising a ridge on one of the side surfaces and the inward faces and a corresponding groove on the other of the side surfaces and the inward faces, whereby the joint piece can be positioned easily and accurately during assembly to strengthen the joint.

The knockdown chair of this invention includes a back rest frame having two back legs integrally formed therewith; a plurality of substantially trapezoidal joint pieces; a quadrilateral seat support member for supporting a seat, having a back support fixed on the back rest frame at an appropriate location for a seat, a front support and two side supports. The seat support member extends perpendicularly from the back frame. Front legs extend downward respectively from the seat support member at two ends of the front support, the supports being attached at respective end faces thereof to the back frame and the front legs with said joint pieces in a joint arrangement. The joint arrangement comprises one of said legs of the chair, having two mounting surfaces at lateral sides thereof; a pair of the supports, each attached perpendicularly at one end face thereof to one of the mounting surfaces, therefore having two inward faces forming an angle therebetween; one of the trapezoidal joint pieces having two side surfaces conforming to the angle for being screw attached to one of the leg and the pair of supports; and a guiding means comprising a ridge on one of the side surfaces and the inward faces and a corresponding groove on the other of the side surfaces and the inward faces, whereby the joint piece can be positioned easily and accurately during assembly to strengthen the joint.

In one aspect of the invention, the supports and the legs are respectively attached by attaching means, each attaching means being disposed in and between one of the supports and one of the legs. The attaching means each include a bolt and a cylindrical member, each bolt having a head at one end and a screw thread at another, the cylindrical member having a bolt hole in one end thereof for receiving the bolt and a pin hole in a side of the cylindrical member extending perpendicularly to a longitudinal axis of the bolt hole. A cylindrical hole is formed in one of the mounting surfaces of one of the legs, the cylindrical hole being sized to seat the respective cylindrical member. Locking pin means is provided for insertion into the pin hole of the cylindrical member. A longitudinal guide recess is formed in a side of the support near an end thereof, and a bolt hole extends from an interior side of the guide recess to an end face of the support respectively, a longitudinal axis of the recess being parallel to a longitudinal axis of the bolt hole. The bolt hole is sized to receive the threaded portion of the bolt, and the guide recess is sized to allow passage of the threaded portion of the bolt and receive the head portion in a deep portion thereof away from the surface of the support, so that the bolt may be inserted into the bolt hole and received in the cylindrical member seated in the leg, and the head will rest inside the guide recess of the support, completely out of sight.

In another aspect of the invention, the support is straight, and a longitudinal axis of the bolt hole and the guide recess are perpendicular to the end face of the support.

In a further aspect of the invention, the chair further includes a curved L-shaped arm rest. A long arm of the L-shaped has a flat end face attached to the back frame by means of the attaching means, and a longitudinal axis of the bolt hole and the guide recess is at an oblique angle to the end face of the arm rest.

A presently preferred embodiment of this invention will be described in detail below, with reference to the appended drawings, in which:

DRAWINGS

DETAILED DESCRIPTION OF THE EMBODIMENT

Figure 1:
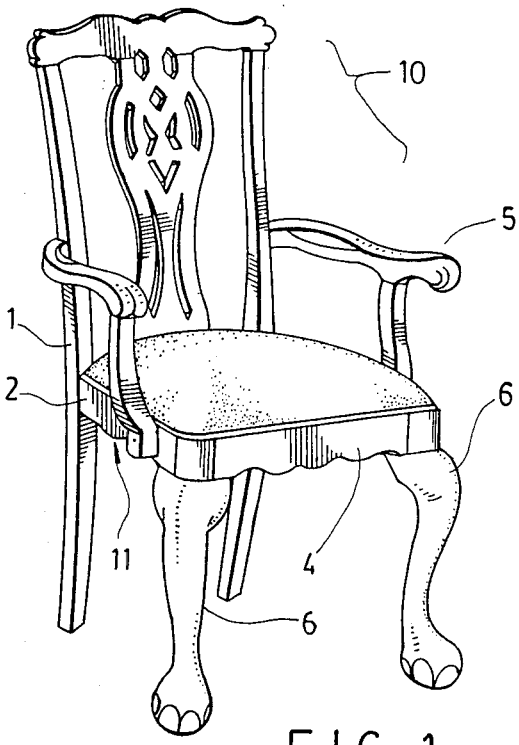
FIG. 1 is perspective view of a knockdown chair of this invention in assembled condition.
Figure 2:
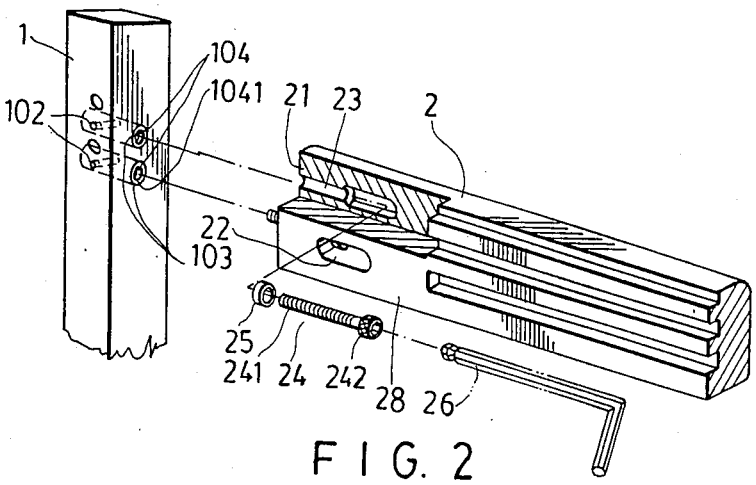
FIG. 2 is a partially exploded view of the joint assembly between the side support and back frame of the chair of FIG. 1.
Figure 3:
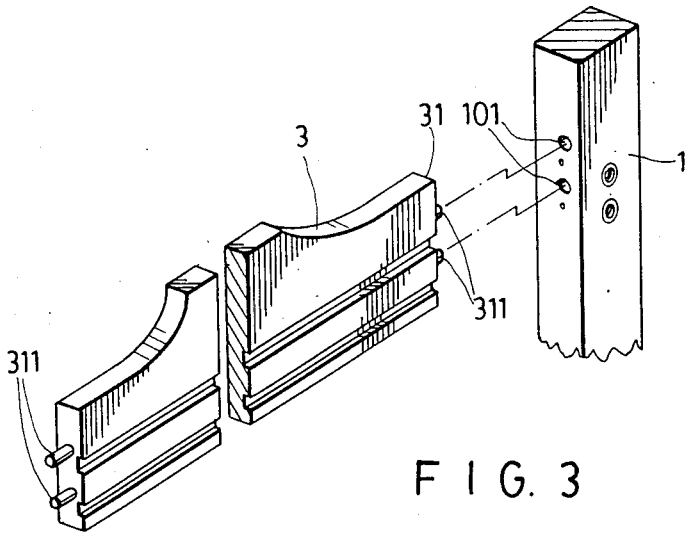
FIG. 3 is a partially exploded view of the joint between the back support and back frame of the chair of FIG. 1.
Figure 4:
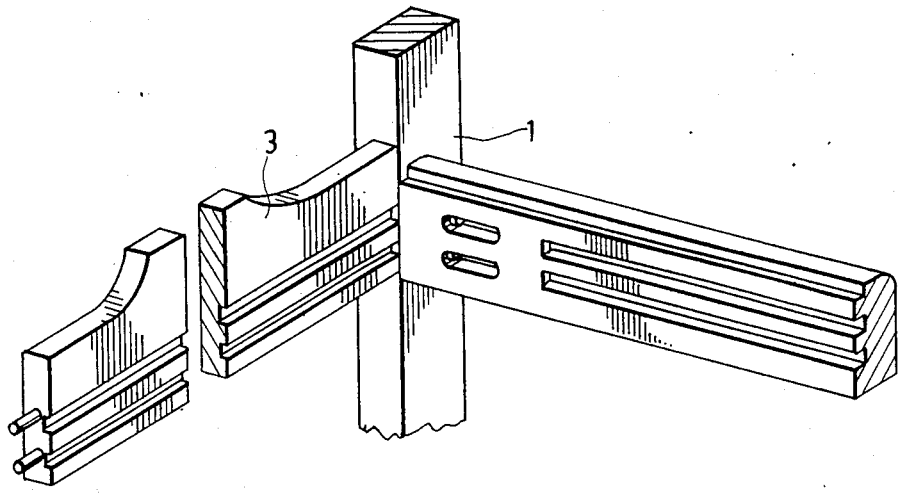
FIG. 4 is a view of the assembled joint assembly shown in FIGS. 2 and 3.
Figure 5:
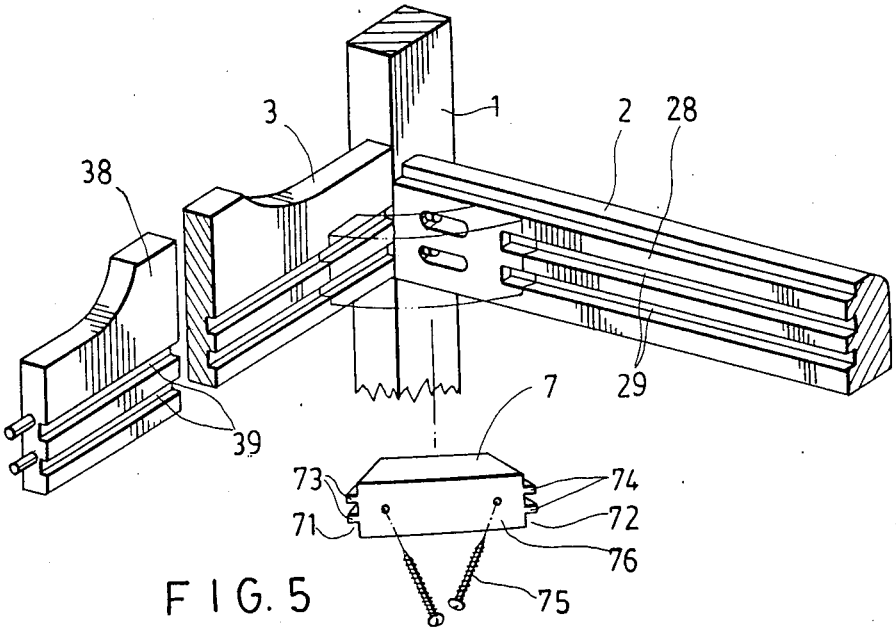
FIG. 5 is a perspective view of a joint arrangement of this invention used in the chair of this invention.
Figure 6:
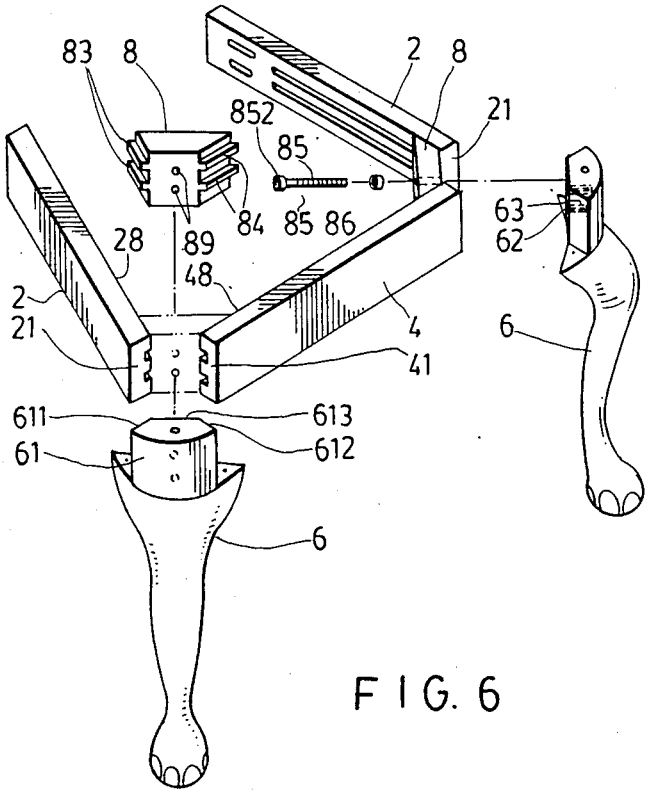
FIG. 6 is an exploded perspective view of the joint arrangement of this invention used with the seat support member and the front legs of the chair of this invention.

Referring to the drawings, especially to FIGS. 1, 5, and 6, an improved knockdown armchair according to this invention includes a wooden armchair body 10 including a back rest frame 1 having two back legs integrally formed therewith; a plurality of substantially trapezoidal joint pieces 7, 8; a quadrilateral seat support member 11 for supporting a seat, having a back support 3 fixed on said back rest frame 1 at an appropriate location for a seat, a front support 4 and two side supports 2, the seat support member 11 extending perpendicularly from the back frame 1; and front legs 6 extending downward respectively from the seat support member 11 at two ends of the front support 4. The supports 2, 3, 4 are wooden spars with flat end faces 21, 31, 41 and are attached at the end faces 21, 31, 41 to legs of the back frame 1 and the front legs 6 with the joint pieces 7, 8 in a joint arrangement.

The construction of the joint arrangements of the side supports 2, back support 3 and legs of the back frame 1 can be seen best in FIGS. 2, 3, 4, and 5A and 5B. The legs of the back frame 1 are of rectangular cross section and back support 3 and side supports 2 are attached by their end faces 31, 21 to adjacent sides of the legs of the frame 1. Back support 3 has two dowel pin protrusions 311 extending from each of its end faces 31 which fit and are glued into two pin holes 101 of the side of the leg of the back frame 1. The same side of the leg further has two smaller holes 102 extending perpendicularly into the leg of the back frame 1. The adjacent side of the leg, to which side support 2 is to be jointed, further has two cylindrical holes 103 extending perpendicularly into the leg, the smaller holes 102 being communicated in radial direction with the cylindrical holes 103. The cylindrical holes 103 respectively seat cylindrical bushings 104 which each have a longitudinal threaded hole 1041 and a radial hole perpendicular to the longitudinal hole 1041 and conforming to a smaller hole 102 of the leg of the back frame 1 so that, when the bushing 104 is seated in the cylindrical hole 103, a pin may be radially inserted through the smaller hole 102 and the radial hole of the bushing 104 to fix the bushing 104 in the cylindrical hole 103.

To attach the side supports 2 to the legs of the back frame 1, each side support 2 includes two longitudinal guide recesses 22 in an inward face 28 thereof and two bolt holes 23 extending respectively from an inside portion of each longitudinal guide recess 22 to the end face 21, perpendicularly to the end face 21. The inward face 28 is the side surface of the side support 2 which faces the back support 3 when the side support is attached to the back frame 1. (The back support 3 also has an inward face 38 facing the inward face 28 so that when the back support, back frame 1 and side supports 2 are attached, angles are formed respectively between the inward face 38 and respective inward face 28). Each guide recess 22 is sized to receive and guide a bolt 24 to be inserted through the bolt hole 23 threadedly into the longitudinal threaded hole 1041, wherein a threaded portion 241 of the bolt 24 is received in the bolt hole 23 and bushing 104, while a head portion 242 of the bolt 24 remains in the guide recess 22, out of sight. The bolt 24 is held in place by a washer 25. The head 242 of the bolt 24 has a recess for receiving the end of a L-shaped hexagonal head wrench 26 which can tighten the bolt 24 after it is received in the recess 22.

Referring to FIG. 5, the back joints are strengthened by the joint arrangement according to this invention, which includes joint pieces 7 in a substantially trapezoidal shape with trapezoidal sides 71, 72 conforming to the angle between the inward faces 28, 38; and a guiding means comprising longitudinal grooves 29, 39 in the inward faces 28, 38 and corresponding ridges 73, 74 in the trapezoidal sides 71, 72 of the joint pieces 7. The guiding means is used to slide the joint pieces 7 between the back support 3 and the respective side support 2 towards the back frame 1. Two screws 75 are screwed obliquely through the base side 76 of each trapezoidal joint piece 7 through the sides 71, 72 and into the inward faces 38, 39 to fix the joint pieces 7 therebetween and complete the joint arrangement.

The joints between the side supports 2, the front legs 6, and the front support 4 are constructed in a substantially similar manner. The front legs 6 have top portions 61 shaped in a substantially trapezoidal form with a curved base at the outside of the leg, two mounting sides 611, 612, and a flat top 613. The front support 4 and side supports 2 are to attached to the mounting sides 611, 612 in the same manner, using bolts and bushings, as the side supports 2 are the back frame 1. Joint trapezoidal pieces 8 having ridges 83, 84 on two sides thereof which fit into grooves of the inward faces 28, 48 of the side and front supports 2, 4 are slid between the inward faces 28, 48 towards the top portions 61 of the legs, so that the trapezoidal top of the joint pieces 8 meet the flat top 613. Two cylindrical recesses 62 are formed extending perpendicularly inward from the flat top 613, and a bushing 63 is fixed in each recess 62, each bushing 63 having a longitudinal threaded hole (not shown). Two bolts 85, each with a threaded end 851 and a head 852, are passed respectively through channels 89 of joint pieces 8 from the base to the top thereof and threaded into the bushings 63, completing the joint arrangement. The bolts 85 are provided with washers 86 to fix them in place.

As can be seen in FIG. 6, as the supports 2, 3, 4, back frame 1, front legs 6 and joint pieces 7, 8 are all respectively mutually fixed together, the seat support member 11 thus formed and the legs have very strong joints. The guiding means of the joint arrangement ensures swift and accurate positioning of the components of the joint relative to each other, and the construction of the joint is such that the bolts and screws holding it together are invisible from the outside of the chair.

Figure 7:
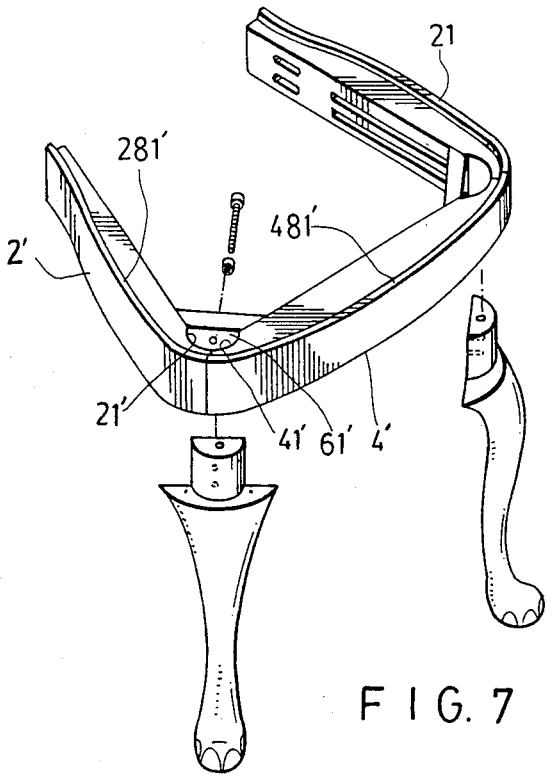
FIG. 7 is an alternate embodiment of the seat support member and the front legs using the joint arrangement of this invention.

In another embodiment of this invention, as shown in FIG. 7, side and front support 2', 4' are provided with flange portions 281', 481' along the outside thereof, and the top portions 61' of the legs 6' are respectively set in slightly from the outside of the legs 6' to accommodate the flange portions 281', 481', which are curved to meet each other at a central portion of the top portion 61' to hide the latter from view. In this embodiment, the end faces 21', 41' are curved to fit closely with top portion 61', which is hemispherical.

The armchair 10 further includes an armrest 5 attached to the back frame 1 and seat support member 11 in the same way as the side supports 2 are attached to the back frame 1.

While this invention has been described with reference to a preferred embodiment, it is apparent that various modifications and variations can be made without departing from the scope of the invention. It is therefore intended that the invention be limited as indicated in the appended claims.

I claim:

1. An improved knockdown chair, including a back rest frame having two back legs integrally formed therewith; a plurality of substantially trapezoidal joint pieces; a quadrilateral seat support member for supporting a seat having a back support fixed on said back rest frame at an appropriate location for a seat, a front support and two side supports, each support having two end faces, said seat support member extending perpendicularly from said back frame; and front legs extending downward respectively from said seat support member at two ends of said front support, said supports being attached at respective said end faces thereof to said back frame and said front legs with said joint pieces in a joint arrangement wherein said joint arrangement comprises one of said legs of said chair having two mounting surfaces at lateral sides thereof; a pair of said side supports each attached perpendicularly at one end face thereof to one of said mounting surfaces therefore providing two inward faces forming an angle therebetween; one of said trapezoidal joint pieces having two side surfaces conforming to said angle for being screw attached to said seat support member; and a guiding means comprising a ridge on one of said side surfaces and said inward faces and a corresponding groove on the other of said side surfaces and said inward faces, whereby said joint piece can be positioned easily and accurately during assembly to strengthen said joint said supports and said legs being respectively attached by attaching means, each attaching means being disposed in and between one of said supports and one of said legs, including a bolt and a cylindrical member, each bolt having a head at one end and a screw thread at another, said cylindrical member having a bolt hole in one end thereof for receiving said bolt and a pin hole in a side of said cylindrical member extending perpendicularly to a longitudinal axis of said bolt hole, means forming a cylindrical hole in one of said mounting surfaces of one of said legs, said cylindrical hole being sized to seat said respective cylindrical member, locking pin means for insertion into said pin hole of said cylindrical member, means forming a longitudinal guide recess in a side of said support near an end thereof, means forming a bolt hole extending from an interior side of said guide recess to an end face of said support respectively, a longitudinal axis of said recess being parrallel to a longitudinal axis of said bolt hole, said bolt hole being sized to receive said threaded portion of said bolt, said guide recess being sized to allow passage of said threaded portion of said bolt and receive said head portion in a deep portion thereof away from the surface of the support, whereby, said bolt may be inserted into said bolt hole and received in said cylindrical member seated in said leg, and said head will rest inside the guide recess of said support, completely out of sight.

2. An improved chair as claimed in claim 1, wherein said support is straight, and a longitudinal axis of said bolt hole and said guide recess are perpendicular to said end face of said support.

3. An improved chair as claimed in claim 1, further including an curved L-shaped arm rest, wherein a long arm of said L-shaped has a flat end face attached to said back frame by means of said attaching means, and wherein a longitudinal axis of said bolt hole and said guide recess is at an oblique angle to said end face of said arm rest.

* * * * *